US008150568B1

(12) United States Patent
Gray

(10) Patent No.: US 8,150,568 B1
(45) Date of Patent: Apr. 3, 2012

(54) RAIL SYNTHETIC VISION SYSTEM

(76) Inventor: Robert Gray, Erie, PA (US)

( * ) Notice: Subject to any disclaimer, the term of this patent is extended or adjusted under 35 U.S.C. 154(b) by 1154 days.

(21) Appl. No.: 11/600,654

(22) Filed: Nov. 16, 2006

(51) Int. Cl.
*G05D 1/00* (2006.01)
*G05D 3/00* (2006.01)
*G06F 17/00* (2006.01)

(52) U.S. Cl. ..... 701/19; 701/20; 701/23; 701/300

(58) Field of Classification Search ..... 701/19, 701/20, 300, 23; 340/10.1, 572.1; 246/15, 246/25, 120, 167 R, 108, 294, 296, 293, 295, 246/95, 98, 124, 401, 26
See application file for complete search history.

(56) References Cited

U.S. PATENT DOCUMENTS 3,339,068 A * 8/1967 Staples ..... 246/122 R
3,342,989 A * 9/1967 Dwyer et al. ..... 246/122 R
5,744,707 A * 4/1998 Kull ..... 73/121
5,765,122 A * 6/1998 Nagai et al. ..... 701/208
5,978,718 A * 11/1999 Kull ..... 701/19
5,995,881 A * 11/1999 Kull ..... 701/20
6,179,252 B1 * 1/2001 Roop et al. ..... 246/293
6,218,961 B1 * 4/2001 Gross et al. ..... 340/903
6,267,332 B1 * 7/2001 Almblad ..... 246/294
7,395,140 B2 * 7/2008 Christie et al. ..... 701/19
7,455,225 B1 * 11/2008 Hadfield et al. ..... 235/384
2003/0222981 A1 * 12/2003 Kisak et al. ..... 348/148
2005/0110628 A1 * 5/2005 Kernwein et al. ..... 340/457
2005/0192720 A1 * 9/2005 Christie et al. ..... 701/19
2005/0228620 A1 * 10/2005 Convert et al. ..... 703/1
2005/0253926 A1 * 11/2005 Chung et al. ..... 348/148
2007/0124332 A1 * 5/2007 Ballesty et al. ..... 707/104.1
2008/0068164 A1 * 3/2008 Campbell ..... 340/572.1

* cited by examiner

*Primary Examiner* — Khoi Tran
*Assistant Examiner* — Jorge Peche
(74) *Attorney, Agent, or Firm* — Mark W. Scott; Scott Intellectual Property Law, PLLC

(57) ABSTRACT

A synthetic image is produced which will be viewed by an operator of a train to provide the operator with important information indicative of the environment to be encountered by the train during subsequent movement of the train. This information includes information about upcoming track and highway crossings. The synthetic image may be utilized during all periods of operation of the train but will be particularly desirable during night and during periods of bad weather, such as rain, snow and fog, when normal vision is limited. The system utilizes accurate measurement of the location of the train, accurate knowledge of the path of the track and accurate knowledge of placement of track and highway crossings. Automated horn soundings, or monitoring of manual operator activations, significantly enhance safety at such track and highway crossings.

12 Claims, 8 Drawing Sheets

FIG. 3
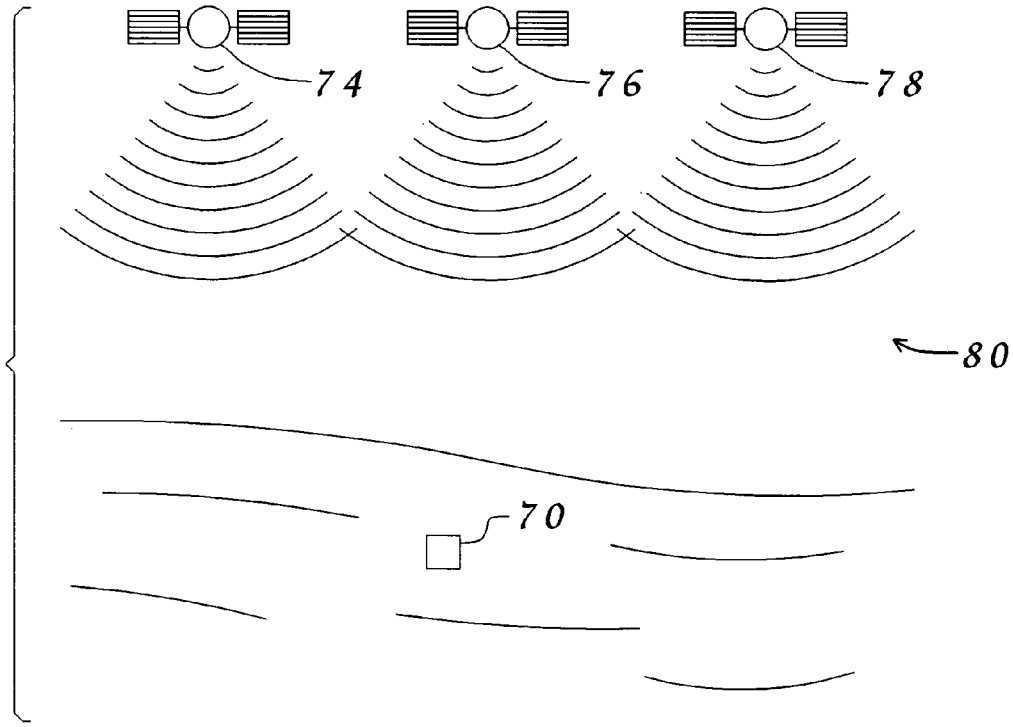
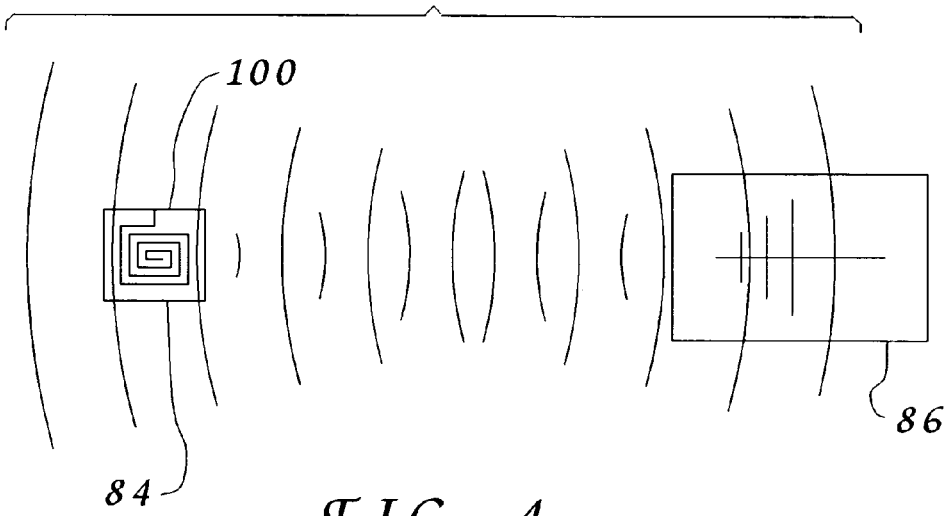
FIG. 4

RAIL SYNTHETIC VISION SYSTEM

BACKGROUND

1. Field of the Invention

Generally, the invention relates to systems for production of a realistic graphical view of an environment to be encountered during movement of a vehicle. More specifically, the invention relates to such systems for use with rail vehicles to provide the operator of locomotives with useful information about conditions to be encountered including information about upcoming track and highway crossings.

2. Description of the Prior Art

Rail based vehicles travel along fixed position rail tracks. Typically, such rail tracks have numerous junctures where a selection of divergent rail paths may be taken. Typically, rail based vehicles travel along a respective path during a specific trip with various predetermined path options being implemented. Numerous segments of rail tracks exist throughout the world, with many of these segments located in the United States of America. Most, if not all, of such rail tracks have been precisely surveyed with detailed identifying data encoded in computational databases. Applicable identifying data including information sufficient to determine precise coordinates of location and elevation along a path of a respective section of the rail track. Such identifying data may include precise path descriptions, track branching descriptions, track intersection point descriptions with other tracks, land based roads and highways, bridge descriptions and tunnel descriptions.

Positive train control (PTC) systems are integrated command, control, communications, and information systems conventionally known in the art for controlling train movements with safety, security, precision, and efficiency. Positive train control systems improve railroad safety by significantly reducing the probability of collisions between trains, casualties to roadway workers and damage to their equipment, and over speed accidents.

Positive train control systems may have digital data link communications networks, continuous and accurate positioning systems, on-board computers with digitized maps on locomotives and maintenance-of-way equipment, in-cab displays, throttle-brake interfaces on locomotives, wayside interface units at switches and wayside detectors, and control center computers and displays.

Various methods are known in the art to determine a location of an object, including a moving object. GPS (global positioning system) devices are well known in the art to determine a position measurement.

Radio frequency identification (RFID) tags are known to store information which may be retrieved by a receiver. RFID tags may be positioned in fixed locations with the stored information indicative of the location of the respective RFID tag. Radio frequency identification (RFID) is an identification method, relying on storing and remotely retrieving data using devices called radio frequency identification tags or transponders. A radio frequency identification tag can be positioned relative to a location, attached to an object or inserted into an object, animal or person. Once deployed the radio frequency identification tag may be identified using radio waves. Chip-based radio frequency identification tags contain silicon chips and antennas. Passive radio frequency identification tags require no internal power source, whereas active radio frequency identification tags require a power source.

Passive radio frequency identification tags have no internal power supply. The minute electrical current induced in the antenna by an incoming radio frequency signal provides just enough power for the complementary-symmetry/metal-oxide semiconductor (CMOS) integrated circuit in the tag to power up and transmit a response. Most passive tags signal by backscattering the carrier signal from the reader. This means that the aerial, or antenna, has to be designed to both collect power from the incoming signal and also to transmit the outbound backscatter signal. The response of a passive radio frequency identification tag does not have to be just a simple identification number but can contain nonvolatile storing data.

Active radio frequency identification tags have their own internal power source. Active radio frequency signal tags are typically much more reliable than passive tags due to the ability of active tags to conduct a "session" with a reader. Active radio frequency signal tags, due to their onboard power supply, also transmit at higher power levels than passive radio frequency signal tags, allowing them to be more effective in radio frequency challenged environments like water, metal, or at longer distances. Many active radio frequency signal tags have practical ranges of hundreds of feet with a battery life of up to 10 years. Active tags typically have much larger memories than passive radio frequency signal tags. Additionally, active radio frequency signal may have the ability to store information sent by the transceiver.

Numerous methods exist to improve rail based vehicle safety. Various systems and methods have been proposed to inform the operator of a location of the train along the track including orientation to rail track and highway crossings and speed of the train. Various systems and methods have been proposed to increase safety at rail track and highway crossings. Many of these systems and methods involve notifying, or otherwise alerting, the operators of highway vehicles and pedestrians of the approach of the train.

Traditionally, the operator of a rail based vehicle activates the audible horn sound approximately one-quarter mile from a rail track and highway crossing. The horn warns motorists and pedestrians approaching the intersection that the rail based vehicle is approaching. To be heard over this distance, the audible horn sound must be very loud. This combination of loud horns and the length along the tracks that the horn is sounded creates a large area adversely impacted by the horn noise. In urban areas, this area likely includes many nearby residential dwellings.

An innovation in rail track and highway crossing warning involves providing a similar audible warning to motorists and pedestrians by using two stationary horns mounted at the crossing. Each horn directs its sound toward the approaching roadway. The land based horn system typically is activated using the same track-signal circuitry as the gate arms and bells located at the crossing. Once the land based horns are activated, a strobe light begins flashing to inform the rail based vehicle operator that the horns has been activated and are working. Horn volume data collected near the crossings clearly demonstrate the significant reduction of land area negatively impacted by using the land based horn system. Residents overwhelmingly accepted the land based horn systems and noted a significant improvement in their quality of life. Motorists also prefer the land based horn systems. The rail based vehicle operators rated these crossings slightly safer compared to the same crossings before the change to the land based horn system.

Various automated crossing guards deployment, with audio and visual alerting, having been proposed. Many crossings, particularly in rural areas, lack crossing arms which are lowered to block traffic while trains pass. Various train mounted horn soundings are mandated when approaching crossings to warn highway vehicle operators of the approach of the train. Typically such train mounted horn soundings are manually activated by the operator of the train although automated activation systems are known in the art. Due to the extremely long stopping distance of typical trains, depending upon various factors including speed of the train and weight of the train, it typically falls to the highway vehicle operators to remain out of the path of the train. Therefore it is of paramount importance to provide proper audio warning of the approach of trains. This is complicated due to a strong desire of train operators not to unduly disturb persons residing near rail track and highway crossings with premature activation of horn sounding when approaching the crossing. Further complicating such horn soundings is that trains travel at various speeds, depending upon many factors, when passing respective crossings. Additionally, trains operate around the clock including at night when visibility is limited to the operator of the train. Trains also operate in all weather conditions including during heavy rain, during snow storms, including white out conditions, and during periods when dense fog is present. These conditions often cause the operator to come upon a crossing without the desired time interval to properly activate the horn soundings. Various systems and methods have been proposed to notify the operator of the train to manually activate the horn soundings or to automatically activate the horn soundings. In the field of automated activation of the horn soundings when approaching crossings, conventionally known systems typically rely upon a fixed point along the track which when arrived at activates the horn soundings. These systems typically do not afford the capacity to factor in other relevant information such as the speed of the train, the weight or length of the train, and conditions affecting visibility, such as the time of day or night.

As can be seen various attempts have been made to improve safety of the operation of trains including such operation at track and highway crossings. These attempts have been less efficient than desired. As such, it may be appreciated that there continues to be a need for a system which provides relevant data to the operator of the train in a visual format which the operator can readily understand and utilize in any operating condition including at night and during periods of adverse weather conditions. The present invention substantially fulfills these needs.

SUMMARY

In view of the foregoing disadvantages inherent in the known types of safety systems for rail based vehicles, your applicant has devised a rail synthetic vision system for an operator of a rail based vehicle. The rail synthetic vision system presents a produced image indicative of the environment to be encountered by the rail based vehicle during subsequent movement of the rail based vehicle for use by the operator. The rail synthetic vision system has production and display means and presentation means. The production and display means provides the operator with a produced realistic graphical view indicative of the rail track and at least select surroundings to be encountered during movement of the rail based vehicle. The operator views a synthetic image indicative of the environment to be encountered by the rail based vehicle during subsequent movement of the rail based vehicle. The presentation means provides the operator with information about upcoming rail track and highway crossings prior to the rail based vehicle arriving at a respective rail track and highway crossing.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide an operator of a rail based vehicle with a produced graphical view of the rail track ahead.

Other objects include;

a) to provide for the produced image to be available to the operator of the train during night when ordinary vision is limited.

b) to provide for the produced image to be available to the operator of the train during adverse weather conditions when ordinary vision is limited.

c) to provide for a rail synthetic vision system which will ensure that proper horn soundings occur at track and highway crossings to significantly enhance safety of land based vehicles and pedestrians at the crossings during passage of trains.

d) to provide for the system to activate the horn soundings at precise locations and times during approach of the train to the crossing, during passage by the crossing and subsequent to the passage of the train beyond the crossing.

e) to provide for the rail synthetic vision system to ensure that horn blowing sequencing according to the established railway standards on approaching railway crossings occurs either automatically or by prompting the operator to perform the soundings.

f) to provide for a rail synthetic vision system which can accurately determine a real time position of the train during operation of the train to permit accurate production of the produced image for use by the operator of the train.

g) to provide for the produced image to be a synthetic perspective view.

h) to provide for the produced image to be a synthetic overhead top view.

i) to provide for the rail synthetic vision system to utilize a database containing precise locations of the rail track and the crossings during production of the synthetic image.

j) to provide for the rail synthetic vision system to utilize a radio frequency identification (RFID) tag system having RFID tags distributed along the path of the track at precisely identified locations and a receiver positioned on the train to provide for determining the real time position of the train during operation of the train, including in tunnels.

k) to provide for the rail synthetic vision system to provide precision millimeter accuracy determination of location utilizing GPS (Global Positioning System) components and/or RFID (Radio Frequency Identification) components.

l) to provide for the rail synthetic vision system to notify the operator of the train about required operator performed actions which have not been performed at the required occasion, including horn soundings at track and highway crossings.

m) to provide for the graphical view of the rail track ahead to display information about upcoming railway crossings.

n) to provide for the rail synthetic vision system to display information about the distance and/or estimated time to the next crossing.

o) to provide for the rail synthetic vision system to display precision information regarding the rail based vehicle including speed of the vehicle.

p) to provide for the rail synthetic vision system to provide excellent information to the rail based vehicle operators in rural areas where track and highway crossing information routinely available to the operator is minimal.

q) to provide for the rail synthetic vision system to reduce train and highway vehicle collision accidents due to train operator negligence and reduce litigation costs for the railroad companies.

r) to provide for the rail synthetic vision system to support modern positive train control (PTC) systems by providing pin-point accuracy position solutions regarding train, track and crossing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 3 is a representation of a portion of the global positioning system and a global positioning system receiver.

FIG. 4 is an representation of a radio frequency identification (RFID) tag and a radio frequency transmitting and receiving unit.

DESCRIPTION

Figure 1:
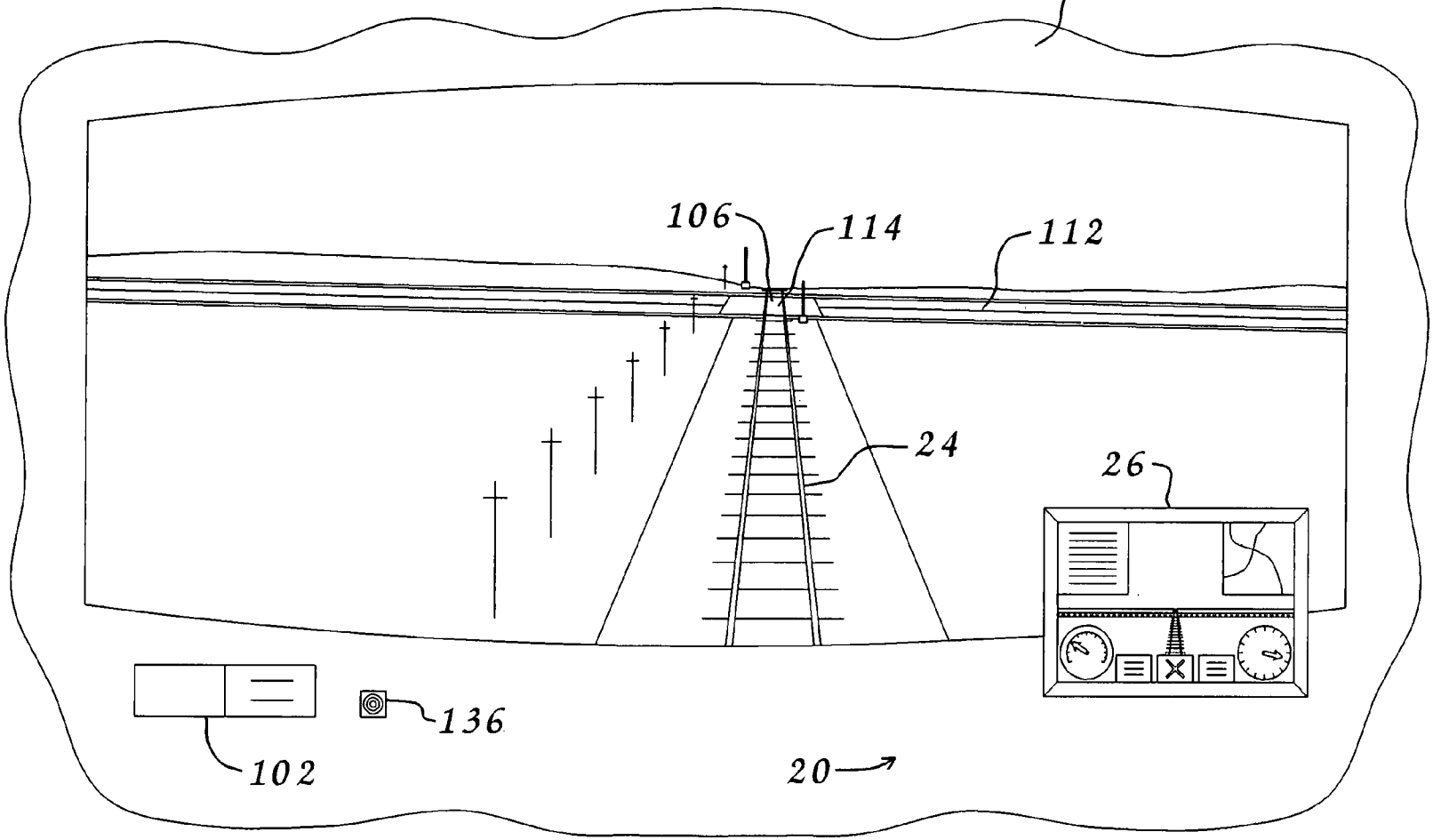
FIG. 1 is an elevational view of a depiction of the view from a cab of a rail based vehicle including an operator display of the rail synthetic vision system.
Figure 2:
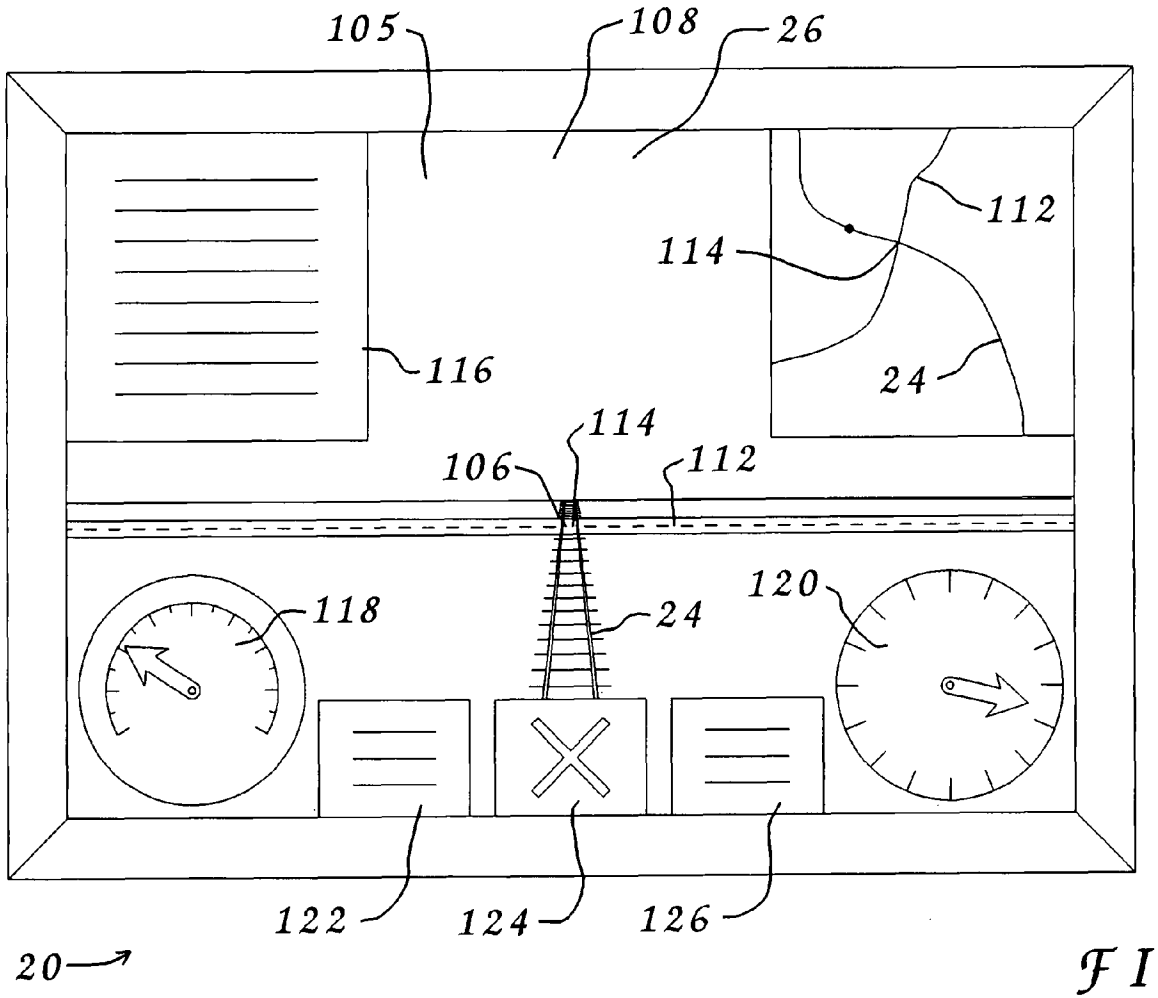
FIG. 2 is an elevational front view of the operator display shown in FIG. 1 and depicting a series of computer created images related to operation of the rail based vehicle thereon.

Many different systems having features of the present invention are possible. The following description describes the preferred embodiment of select features of those systems and various combinations thereof. These features may be deployed in various combinations to arrive at various desired working configurations of systems.

Reference is hereafter made to the drawings where like reference numerals refer to like parts throughout the various views.

Overview

A computer-based rail synthetic vision system (R-SVS) of the present invention provides an operator of a rail based vehicle with a very realistic graphical view of the rail track to be encountered in a two dimensional view or a three dimensional view or various combinations thereof. Preferably the operator display will present the operator of the rail based vehicle with a three dimensional graphical representation of a perspective view from the vehicle in the direction of travel. The point of view of the perspective view may have any desired elevational height relative to the vehicle desired, including significantly above the actual height of the vehicle. Two dimensional views may overlay the primary three dimensional view with relevant information which will assist the operator during operation of the vehicle. Of course, such information may be presented on as many operator displays as desired.

The system may provide the operator with many types of information, including information about upcoming crossings. If desired, the system may automatically activate rail crossing horn soundings with great precision. Alternatively, the system may notify the operator when such actions are to be manually performed. The system may also monitor for manual performance of required task by the operator. If the operator fails to manually perform those tasks, including the rail crossing horn soundings, the system may notify the operator of the task to be performed or the system may implement activation of the task.

The system will operate irrespective of the weather conditions, location on earth, or time of the day. The system is indispensable at night and in harsh weather conditions that limit naked eye visibility. This is particularly desirable when the rail based vehicle approaches a rail track and highway crossing where a government mandated horn-sounding sequence is required to be performed by the operator. The system is also quite precise enough for usage in remote control operation rail vehicles where the operator is in a remote operating location.

A preferred embodiment of the present invention contain the following major components, a track database, a mathematical track model, a navigation system, graphical display program, display means and, optionally, a rail axial speed sensor.

A rail synthetic vision system 20 provides for presenting information to an operator of a rail based vehicle 22. The information presented to the operator of rail based vehicle 22 will be based, at least in part, on accurate determinations of position estimates of rail based vehicle 22 during travel along a rail track 24. The information presented to the operator of rail based vehicle 22 will include a produced image 26 indicative of the environment to be encountered by rail based vehicle 22 during subsequent movement of rail based vehicle 22 along rail track 24. Produced images 26 will be presented in a continuous manner presenting visual information in real-time to the operator of rail based vehicle 22. Rail synthetic vision system 20 may provide additional information to the operator of rail based vehicle 22 as desired.

Rail synthetic vision system 20, in the preferred embodiment depicted, contains a track database 28, a navigation system 30, a mathematical track model program 32, graphical display program 34, an operator display 36 and a rail axial speed sensor 38.

Track Database

It is a requirement of the present invention that data be available to the system indicative of a location and a path of rail tracks upon which the rail based vehicle will travel and indicative of at least locational positions of track and highway crossings. The provided information will be stored in a track database. Additional information may be provided within the track database indicative of other locational positions of associated objects and events, such as routine stopping points, bridges and tunnels. The term track database is not intended to be limited to a single storage file but may extend to a series of associated storage files. Certain of the data contained in the track database may be generally stable and not be updated after initial creation. Certain of the data contained in the track database may be routinely, or even constantly, updated and changed depending upon changing conditions.

Many computational arrangements are known in the art to provide for storage and retrieval of information and many of these may be utilized with the present invention. The track database will be accessible by the system during operation of the rail based vehicle. Storage of the data may occur within equipment carried by the rail based vehicle, within equipment at a remote location, or locations, or a combination thereof.

Figure 5:
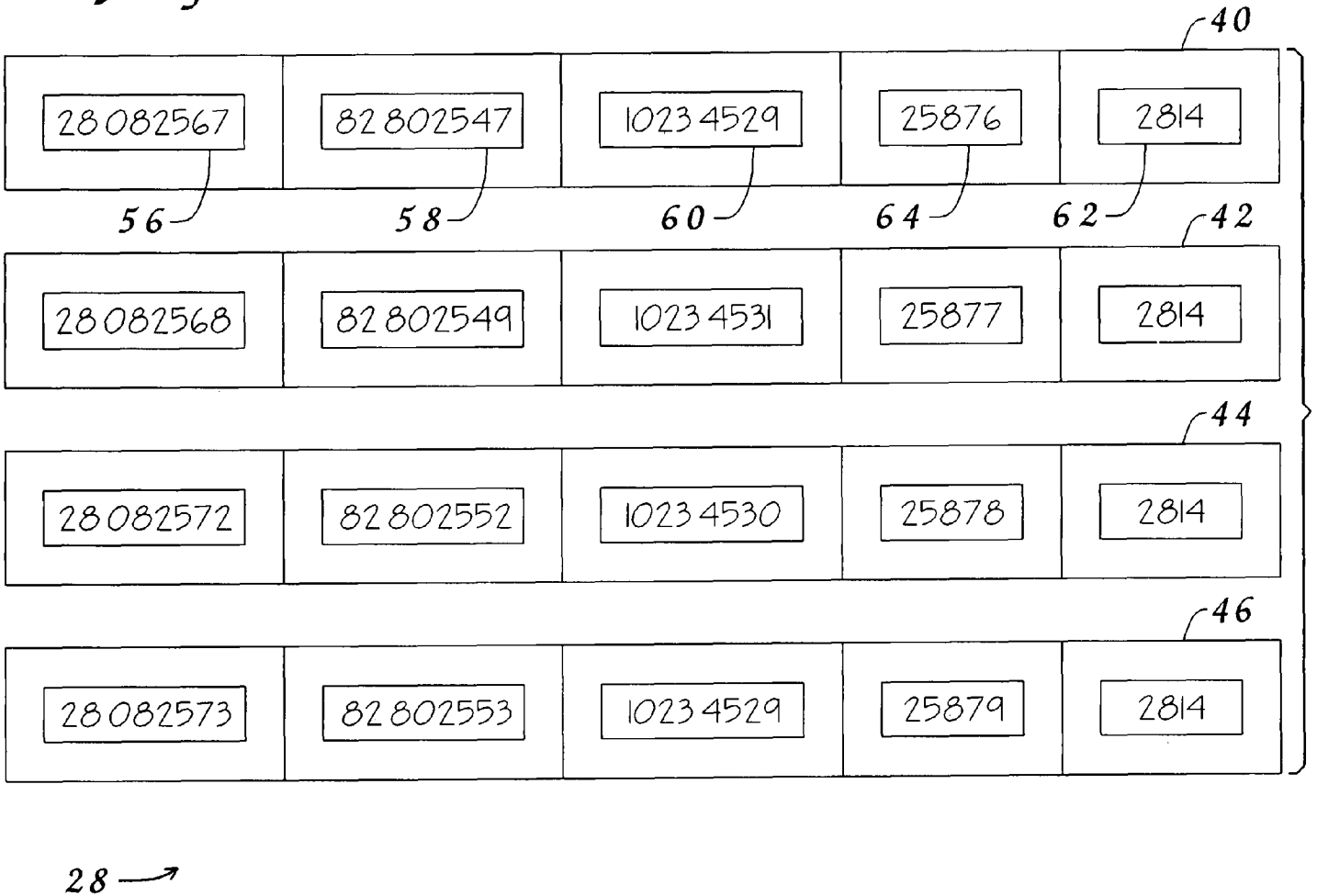
FIG. 5 is a representation of a portion of a track database having a series of records.
Figure 7:
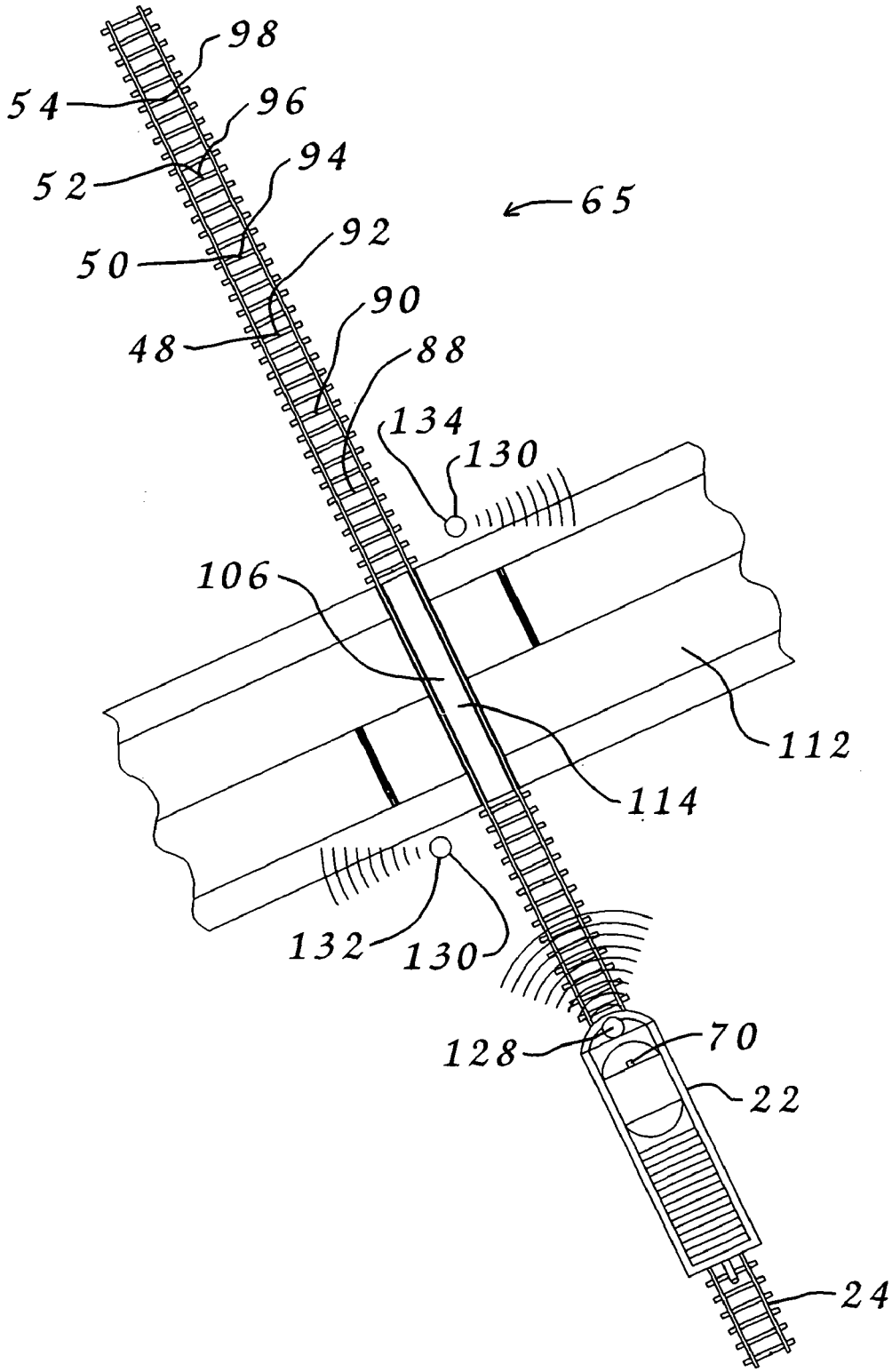
FIG. 7 is a top plan view of an intersection of a portion of a rail track and a portion of a highway with a rail based vehicle positioned on the rail track prior to reaching the intersection.

Track database 28, see FIG. 5, contains a multiplicity of records, such as 40, 42, 44 and 46, each containing information indicative of a physical location 48, 50, 52 and 54 respectively along rail track 24, see FIG. 7. Track database 28 is built from track survey data 55 using method conventionally known in the art. Using record 40 as an example, a longitudinal reference 56, a latitude reference 58 and an elevational reference 60 identify each location in each record. Additionally a condition reference 62 indicates a general physical condition of rail track 24 for each respective record. As an example condition reference 62 indicates that rail track 24 at physical location 48 is along a generally flat rural area. Other references for respective points may indicate that rail track 24 is within a tunnel, on a bridge over water, on a bridge over a highway, under a highway overpass, at a highway crossing or any other definable condition. Additionally, each record will have a unique reference 64 for identification purpose. A multiplicity of records, such as those depicted in FIG. 5, defines a path 65, see FIG. 7, of rail track 24 utilized by rail based vehicle 22.

Navigation System

It is a requirement of the present invention that an estimate of a current position of the rail based vehicle on the rail track be determined by the system. Many location determining systems are known in the art to provide an estimate of the current position of an object and many of these systems may be utilized with the present invention. The term position measurement refers to an initial determination of a position as made by a component of a navigation system.

In a very preferred embodiment of the system two (2) unique position determining methods are employed. This provides for a position determination if either method fails or is unavailable for various reasons. More importantly it provides for a computational comparison of the distinct results of the two (2) position determining methods to arrive at finding a best estimate of the current position of the rail based vehicle.

Various system are known in the art to permit a ground based mobile unit to determine, within various ranges of accuracy, data corresponding to the current location of the ground based mobile unit and many of these may be employed with the present invention.

Satellite navigation systems provide for a receiver to determine the location of the receiver to within a few yards. Generally, this location will be represented as longitude, latitude, and altitude. These systems utilize signals which are continually transmitted by radio from satellites of the system in orbit. The transmitted signals each contain a reference to the position of the satellite and a reference to the precise time. The receiver performs computational processes upon these signals to arrive at the data indicative of the location of the receiver. The 'global positioning system', as conventionally known in the art, is an operational example of a fully functional satellite navigation system which may be utilized with the present invention.

Satellite navigation systems, as conventionally known in the art, provide for tracking moving objects and which continuously refresh on a predetermined cycle. Typically such systems cycle many times a minute with a new positional determination made during each cycle. Such systems are examples of continuous determination navigation systems. A minor problem in utilizing satellite navigation systems for the present invention is that trains travel through tunnels which may interfere with full function of the system.

A RFID (Radio Frequency Identification) track tag navigation system is herein disclosed wherein a multiplicity of RFID tags are distributed along a rail track segment at precisely defined locations. A receiver is positioned on the rail based vehicle where the information stored by a respective tag may be determined during passage of the tag by the receiver during movement of the rail based vehicle. The information stored by each respective tag may directly identify the location of the respective tag, such as longitude, latitude, and altitude, or may provide a reference which permits the system to determine such information, such as from within a database. The RFID track tag navigation system disclosed is an example of a sampling determination navigation system.

Placement of the RFID tags will depend upon the configuration of the RFID track tag navigation system selected and deployed. A spacing will exist between each adjacent pair of RFID tags deployed. This spacing may be uniform or may be variable depending upon track conditions and the deployment configuration selected. The RFID tags may be positioned corresponding to a center line of the tracks, on either side of the center line of the tracks or a combination thereof. The spacing of deployed RFID tags from the center line of the tracks does not have to be uniform. Very directional specific receivers are possible which broadcast signals and receive return signals from RFID tags along a narrowly defined linear path or along a narrowly defined planar path. A particularly desirable placement location for the RFID tags is on the ties, which are bars, generally of wood, concrete or steel, which reside under the rails and support them. While a generally tie level placement is preferred, the RFID tags may be positioned on objects where the RFID tags are elevated above tie level or may be positioned where the RFID tags are below tie level. While it is possible to deploy the RFID tags in a clearly visible fashion, it is preferred to hide or otherwise conceal the RFID tags to prevent tampering. Additionally, it is preferred to have a sequence reference of RFID tags known to the system to prevent unauthorized redeployment of the RFID tags along the rail track segment.

In an example of uniform spacing each RFID tag deployed may be positioned along the track corresponding to precisely six feet apart for measurement of a center line of the tracks. In curves along the track this would result in a greater actual spacing of tags positioned on the outside of the center line of the tracks and a lesser actual spacing of tags positioned on the inside of the center line of the tracks.

In an example of variable spacing of RFID tags the spacing may significantly decrease during alterations in path of the center line of the tracks. An example of this spacing may have more RFID tags positioned in close proximity to each other when translating from linearly straight section of track to a curved section and when translating from a curved section of track to a straight section. Similarly when a prolonged section of straight track is encountered the spacing between RFID tags may significantly increase.

Navigation system 30 comprises a first position measurement system 66 and a second position measurement system 68. First position measurement system 66 utilizes a global positioning system (GPS) receiver 70. Second position measurement system 68 utilizes a radio frequency identification (RFID) tag navigation system 72.

First position measurement system 66 utilizes satellites 74, 76 and 78 of global positioning system 80, as conventionally known in the art. Global positioning system receiver 70, utilizing signals transmitted by satellites 74, 76 and 78, determines a first position measurement 82 indicative of a location of global positioning system receiver 70. Global positioning system receiver 70 will update a determination of respective locations based upon a frequency defined for navigation system 30. In practice global positioning system receiver 70 will be positioned on rail base vehicle 22 to move with rail based vehicle 22 along path 65 of rail track 24.

Second position measurement system 68 utilizes a multiplicity of radio frequency identification (RFID) tags 84 distributed at precisely defined locations and a radio frequency transmitting and receiving unit 86, see FIG. 4. Radio frequency identification (RFID) tag navigation system 72, utilizing signals from radio frequency identification (RFID) tags 84, determines a second position measurement 87 indicative of a location of radio frequency transmitting and receiving unit 86. Radio frequency transmitting and receiving unit 86 will be positioned on rail based vehicle 22 to move with rail based vehicle 22 along path 65 of rail track 24. FIG. 7 depicts a series of radio frequency identification (RFID) tags 88, 90, 92, 94, 96 and 98 which contain data to define path 65 of rail track 24.

Each radio frequency identification (RFID) tag 84 will have a unique characteristic which may be determined by radio frequency transmitting and receiving unit 86. The unique characteristic, in the form of data, of a respective radio frequency identification (RFID) tag 84 will permit production of a position measurement indication of a locational position 100 associated with the respective radio frequency identification (RFID) tag 84.

Mathematical Track Model

The term position estimate refers to a final use determination of a position as arrived at by the mathematical track model utilizing at least the track database and one (1) position measurement. It is a requirement of the present invention that a relatively continuous determination be made of accurate position estimates for the rail based vehicle with which the system is operating. These positional locations will correspond to positions along the rail path defined in the track database. These position estimates will be constantly updated at intervals as required by the system. Various computational processes, conventionally known in the art, may be employed to arrive at each position estimate.

Various information available to the system will be utilized to arrive at a respective position estimate utilizing a mathematical track model. The structural configuration of the system will determine what information is available to the system for use with the mathematical track model. The mathematical track model will utilize the track database and a determination of an estimate of the position measurement of the rail based vehicle provided by the deployed navigation system or systems.

A continuous determination navigation system, such as a global positioning system (GPS), provides rapid cycling to provide each position measurement. In this configuration, without secondary position estimating or speed determination incorporation, it is necessary for the mathematical track model to incorporate the position measurement relative to the data within the track database indicative of the location and the path of rail tracks upon which the rail based vehicle is traveling to arrive at the position estimates.

A sampling determination navigation system, such as the RFID track tag navigation system, will operate with other information, such as speed of the rail based vehicle, to provide each position measurement. In this configuration it is necessary for the mathematical track model to incorporate three (3) distinct data sources. The first is the initial position measurement from an encountered RFID tag. The second is a travel distance of the rail based vehicle based upon speed and time. The third is the data within the track database indicative of the location and the path of rail tracks upon which the rail based vehicle is traveling. The mathematical track model utilized these three (3) distinct data sources to arrive at the position estimates.

It is possible, and desirable, to provide the deployed navigation system to utilize a continuous determination method in combination with a sampling determination method to arrive at extremely precise position estimates.

A computer 102 contains mathematical track model program 32 which relatively continuously processes data from track database 28 and data from the deployed position measurement system(s) 66 and/or 68. Mathematical track model program 32 arrives at respective position estimates, such as a position estimate 103 shown in FIG. 6, each indicative of a final use determination of rail based vehicle 22 on rail track 24 at a given moment of time.

Various methods of accurately determining a speed of a rail based vehicle are conventionally known in the art. Many of these methods may be utilized with the present invention when this feature is desired. A reliable method of determining the speed of the rail based vehicle involves use of a rail axial speed sensor which measures a rotational speed of an axle of the rail based vehicle. The determination of speed of the rail based vehicle may be used for several purposes by the system. One example of such a use involves accurately determining location subsequent to a separate determination by the position determining method of the navigation system. This is particularly desirable when a sampling determination navigation system, such as the RFID track tag navigation system, is deployed. This permits an accurate position measurement to be taken by the system from a respective RFID tag then factor in speed and time from the location of the RFID tag to arrive at relatively continuous position measurements.

Various methods, conventionally known in the art, may be utilized to incorporate the measured speed of the rail based vehicle. A Kalman filter is an efficient recursive filter which estimates the state of a dynamic system from a series of incomplete and noisy measurements. When a moving object is being tracked, information about the location, speed, and acceleration of the moving object is measured with a great deal of corruption by noise at any time instant. The Kalman filter exploits the dynamics of the moving object, which govern its time evolution, to remove the effects of the noise and get a good estimate of the location. The estimate of the location of the moving object may be the present time, at a future time, or at a time in the past.

Mathematical track model program 32 may utilize various additional provided data to arrive at the respective position estimates. Rail axial speed sensor 38 provides for a determination of a speed of rail based vehicle 22 along rail track 24, such as speed measurement 104 shown in FIG. 6. Mathematical track model program 32, when provided with this additional speed data, utilizes such data during production of the position estimates for increased accuracy.

Graphical Display Program

Various computational processes are conventionally known in the art to produce a computer created image from data made available to the computational process. These methods can rapidly produce still images which can be displayed at a desired frame rate to produce a continuous moving image. Such technology is commonly used in video games where the produced moving image changes depending upon input from a player or players. It is possible to utilize many of these processes for the production means of the present invention.

Binary space partitioning (BSP) may be utilized with the present invention. It is a method for recursively subdividing a space into convex sets by hyperplanes. This subdivision gives rise to a representation of the scene by means of a tree data structure known as a BSP tree.

Originally, this approach was proposed in three dimensional computer graphics to increase the rendering efficiency. Among other applications are performing geometrical operations with shapes in computer assisted design (CAD) software, collision detection in robotics, three dimensional computer games, and other computer applications that involve handling of complex spatial scenes.

In computer graphics it is desirable that the drawing of a scene be both correct and quick. A simple way to draw a scene correctly is the painter's algorithm. This means draw it from back to front painting the background over with each closer object. However, that approach is quite limited since time is wasted drawing objects that will be overdrawn later, and not all objects will necessarily be drawn correctly.

Z-buffering is the management of image depth coordinates in three dimensional graphics, done in hardware or in software. It is one solution to the visibility problem, which is the problem of deciding which elements of a rendered scene are visible, and which are hidden. Z-buffering is also known as depth buffering.

Z-buffering can ensure that scenes are drawn correctly and eliminate the ordering step of the painter's algorithm, but it is expensive in terms of memory use. BSP trees will split up objects so that the painter's algorithm will draw them correctly without need of a Z-buffer and eliminate the need to sort the objects as a simple tree traversal will yield them in the correct order. It also serves as base for other algorithms, such as visibility lists, which seek to reduce overdraw.

The downside of binary space partitioning is the requirement for a time consuming pre-processing of the scene, which makes it difficult and inefficient to directly implement moving objects into a BSP tree. This is often overcome by using the BSP tree together with a Z-buffer, and using the Z-buffer to correctly merge movable objects onto the background scene.

OpenGL, Open Graphics Library, is a standard specification which is preferred for use with the present invention. OpenGL defines a cross-language, cross-platform application programming interface (API) for writing applications that produce three dimensional computer graphics and two dimensional computer graphics. The interface consists of over 250 different function calls which can be used to draw complex three dimensional scenes from simple primitives. OpenGL was developed by Silicon Graphics and is popular in the video games industry. OpenGL is widely used in CAD, virtual reality, scientific visualization, information visualization, flight simulation and video game development.

Computer 102 contains graphical display program 34 which produces a series of computer created images 105 from various data including that produced by mathematical track model program 32. Computer created images 105 provide the operator of rail based vehicle 22 with a produced realistic graphical view indicative of rail track 24 and at least select surroundings to be encountered during movement of rail based vehicle 22. This provides for the operator of rail based vehicle 22 to view, in any operating condition, a synthetic image indicative of the environment to be encountered by rail based vehicle 22 during subsequent movement of rail based vehicle 22.

Graphical display program 34 produces, for display to the operator of rail based vehicle 22, information about upcoming rail track and highway crossings 106. Such information preferably will include a visual depiction of a typical crossing having similar characteristics to the crossing to be encountered.

Graphical view 108 depicts a perspective view of a produced realistic graphical view. Graphical view 108 also depicts various overlay views providing various information for the operator of rail based vehicle 22. These overlays include a top view 110 of a produced realistic graphical view showing rail track 24, a highway 112 and an intersection 114, a text panel 116 providing various text information regarding operation of rail based vehicle 22 a speedometer 118, a compass 120 and status warnings 122, 124 and 126 to provide warning to the operator of dangerous operating conditions.

Display Means

Many methods of displaying an image are conventionally known in the art and many of these may be used with the present invention. Two of these methods involve projection onto a surface and display on a monitor. In the most preferred embodiment of the present invention a flat screen monitor, or monitors, are provided for the operator of the rail based vehicle to view information provided by the system.

Operator display 36 is a visual device capable of presenting visual information to the operator of rail based vehicle 22. Operator display 36 is one form of presentation means to provide the operator with information about conditions to be encountered by rail based vehicle 22 including information about upcoming rail track and highway crossings 106 prior to rail based vehicle 22 arriving at the respective rail track and highway crossing 106. Rail synthetic vision system 20 continuously updates operator display 36 to ensure that accurate information is being depicted and presented to the operator of rail based vehicle 22.

Production and display means refers to the combination of producing a real-time realistic graphical view indicative of the rail track and at least select surroundings to be encountered during movement of the rail based vehicle and presenting that view to the operator of the rail based vehicle.

Flow Chart

Figure 6:
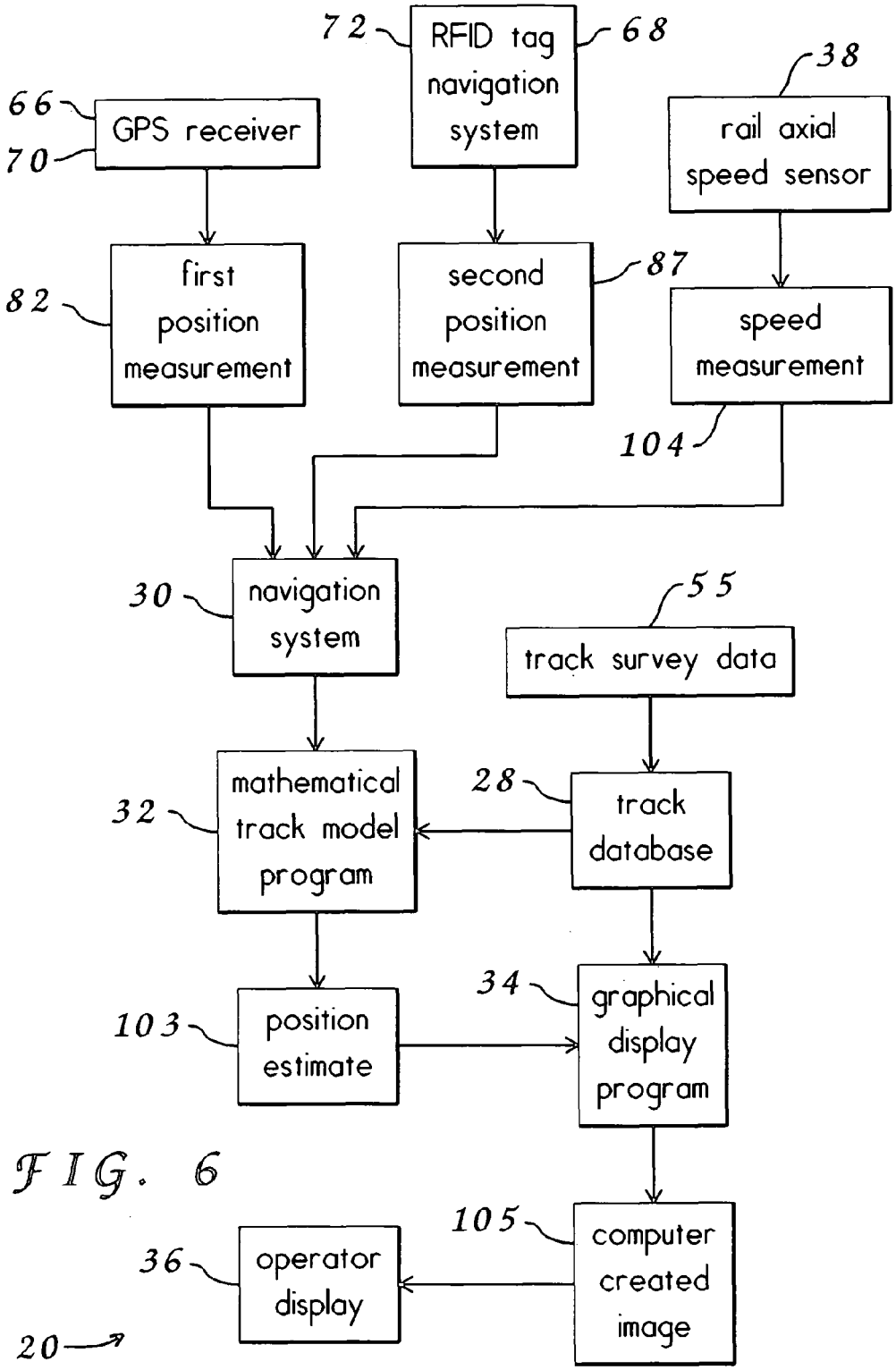
FIG. 6 is a flow chart of a preferred embodiment of the rail synthetic vision system.

Referring now specifically to FIG. 6, an overview of a preferred embodiment of the present invention is provided. First position measurement system 66, in the form of global positioning system (GPS) receiver 70, produces first position measurement 82. First position measurement 82 is passed to navigation system 30 of rail synthetic vision system 20. Second position measurement system 68, in the form of radio frequency identification (RFID) tag navigation system 72, produces second position measurement 87. Second position measurement 87 is passed to navigation system 30 of rail synthetic vision system 20. Rail axial speed sensor 38 produces a speed measurement 104. Speed measurement 104 is passed to navigation system 30 of rail synthetic vision system 20. Track database 28 contains at least track survey data 55. Mathematical track model program 32 accepts various measurements, 82, 87 and 104, from navigation system 30 and information from track database 28. Mathematical track model program 32 outputs a position estimate 103. Graphical display program 34 utilizes position estimate 103 to determine what information from track database 28 to utilized to render computer created image 105. Computer created image 105 is then sent to operator display 36. Depending upon the cycle rate desired at least some of these operations are repetitively performed to provide operator display 36 with a real time produced image indicative of current conditions in the path of the rail based vehicle and the conditions to be encounter during continued travel of the rail based vehicle.

Horn Activation

Horn activation means provides for an activation of a predetermined audible horn sound from a horn 128 at a predetermined orientation of at least a select portion of rail based vehicle 22 and intersection 114 of rail track 24 with highway 112 at rail track and highway crossing 106. Horn 128 of the rail crossing horn sounding is carried on rail based vehicle 22. Horns 130 of the rail crossing horn sounding is positioned in a fixed locations 132 and 134 relative to rail track and highway crossing 106.

Figure 8:
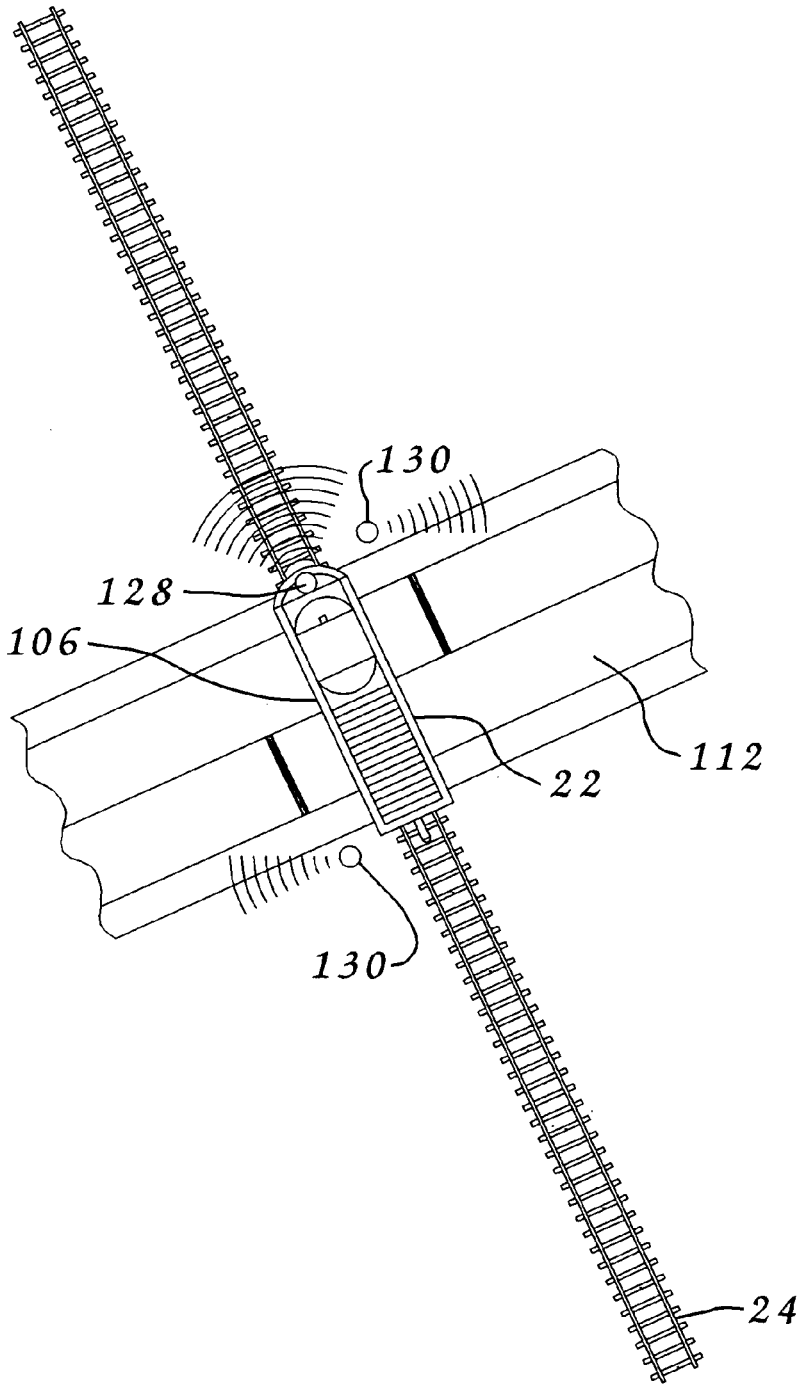
FIG. 8 is a top plan view as shown in FIG. 7 with the rail based vehicle generally within the intersection.
Figure 9:
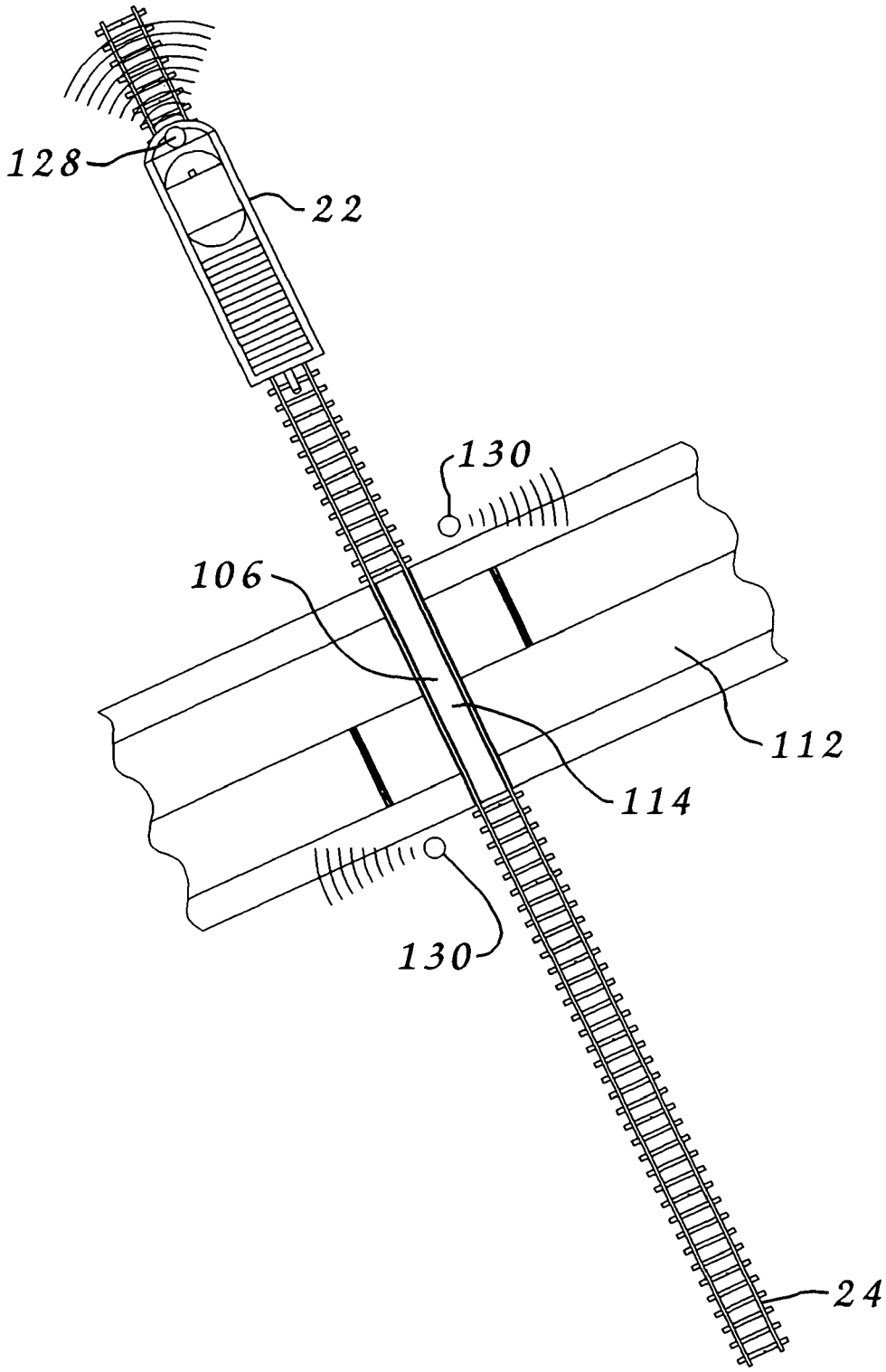
FIG. 9 is a top plan view as shown in FIG. 7 and FIG. 8 with the rail based vehicle positioned on the rail track subsequent to passing the intersection.

FIG. 7 depicts the pre-determined orientation of the select portion of rail based vehicle 22 along rail track 24 prior to rail based vehicle 22 arrival at rail track and highway crossing 106. FIG. 8 depicts the pre-determined orientation of the select portion of rail based vehicle 22 along rail track 24 during actual passage of rail based vehicle 22 by rail track and highway crossing 106. FIG. 9 depicts the pre-determined orientation of the select portion of rail based vehicle 22 along rail track 24 subsequent to rail based vehicle 22 passing rail track and highway crossing 106.

Computer 102 of rail synthetic vision system 20 has location finding means to provide for determining if rail based vehicle 22 has arrived at a pre-determined orientation of at least a select portion of rail based vehicle 22 and intersection 114 of rail track 24 with highway 112 at rail track and highway crossing 106. Based upon this location finding means manual horn sounding testing means provide for determining if the operator has manually activated an audible horn sound of horn 128. If the manual horn sounding testing means determines that the operator has not properly activated the audible horn sound of horn 128 operator notification means provides for notifying the operator that the manual activation of the audible horn sound of horn 128 has not occurred subsequent to the location finding means determining that rail based vehicle 22 has arrived at the pre-determined orientation relative to the respective rail track and highway crossing 106. A buzzer 136, see FIG. 1, is depicted as providing the notification to the operator of rail based vehicle 22. Horn activation means provides for rail synthetic vision system 20 to activate a pre-determined audible horn sound at a pre-determined orientation of at least a select portion of rail based vehicle 22 and intersection 114 of rail track 24 with highway 112 at a respective rail track and highway crossing 106.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rail synthetic vision system for an operator of a rail based vehicle, the rail based vehicle configured to travel along a rail track, the rail synthetic vision system comprising:

a) a track database comprising track survey data indicative of a location and a path of the rail track utilized by the rail based vehicle and a location of at least one crossing along the rail track;

b) at least one navigation system configured to produce at least one position measurement of a current location of the rail based vehicle on the rail track;

c) a Kalman filter configured to produce at least one corrected position measurement of a current location of the rail-based vehicle on the rail track from the at least one position measurement;

d) a computer-based mathematical model configured to correlate the at least one corrected position measurement with the track survey data from the track database to produce a best position estimate of the current location of the rail based vehicle on the rail track;

e) a graphical display program configured to produce a synthetic, real-time image representative of the rail track and at the least one crossing along the rail track that are to be encountered by the rail based vehicle during movement of the rail based vehicle along the rail track, wherein the synthetic, real-time image comprises a view from the rail based vehicle at the best position estimate of the rail based vehicle on the rail track as produced by the computer-based mathematical model; and f) an operator display configured to visually present the synthetic, real-time image for the operator.

2. The rail synthetic vision system of claim 1 wherein the at least one navigation system comprises a radio frequency identification (RFID) tag system having:

a) a plurality of RFID tags distributed along the rail track at predetermined locational positions, each RFID tag having a uniquely identifiable characteristic;

b) a receiver positioned on the rail based vehicle to move with the rail based vehicle along the path of the rail track, the receiver capable of identifying the unique characteristic of respective RFID tags distributed along the rail track.

3. The rail synthetic vision system of claim 2, wherein the at least one navigation system further comprises a global positioning system comprising a global positioning system receiver disposed on the rail based vehicle.

4. The rail synthetic vision system of claim 1 further comprising:

a) means for determining if the rail based vehicle has arrived at a pre-determined orientation of at least a select portion of the rail based vehicle and an intersection of the rail track with a highway at a respective rail track and highway crossing;

b) means for determining if the operator has manually activated an audible horn sound; and c) means for notifying the operator that the manual activation of the audible horn sound has not occurred if manual activation of the audible horn sound has not yet occurred and the means for determining that the rail based vehicle has arrived at the pre-determined orientation relative to the respective rail track and highway crossing.

5. The rail synthetic vision system of claim 1 further comprising means for activating a pre-determined audible horn sound at a pre-determined orientation of at least a select portion of the rail based vehicle and an intersection of the rail track with a highway at a respective rail track and highway crossing.

6. The rail synthetic vision system of claim 1, wherein the synthetic, real-time image comprises at least one of a perspective view or an overhead top view.

7. The rail synthetic vision system of claim 1, wherein the synthetic real-time image comprises information representative of rail and track and highway crossings in the direction of travel of the rail-based vehicle.

8. The rail synthetic vision system of claim 1, wherein the synthetic, real-time image is a continuous moving image.

9. The rail synthetic vision system of claim 1 further comprising a speed sensor to determine a speed of the rail based vehicle along the rail track, and wherein the computer-based mathematical model is configured to produce the best position estimate from at least:

a) a plurality of surveyed points along the rail track contained in the track database;

b) information gathered by the receiver about the respective RFID tags distributed along the rail track; and c) the speed of the rail based vehicle as determined by the speed sensor.

10. A rail synthetic vision system for an operator of a rail based vehicle, the rail based vehicle configured to travel along a rail track, the rail synthetic vision system comprising:

a) a track database comprising track survey data indicative of a location and a path of the rail track utilized by the rail based vehicle and a location of at least one crossing along the rail track;

b) means for producing at least one position measurement of a current location of the rail based vehicle on the rail track;

c) means for producing at least one corrected position measurement of a current location of the rail-based vehicle on the rail track from the at least one position measurement, the means for producing a corrected position measurement comprising a Kalman filter;

d) means for correlating the at least one corrected position measurement with track survey data from the track database to produce a best position estimate of the current location of the rail based vehicle on the rail track;

e) means for generating a synthetic, real-time image based upon the track survey data from the track database and based upon the best position estimate of the rail based vehicle on the rail track, wherein the synthetic, real-time image is representative of the rail track and at least one crossing along the rail track that are to be encountered by the rail based vehicle during movement of the rail based vehicle along the rail track, and wherein the synthetic, real-time image comprises a view from the rail based vehicle at the best position estimate of the rail based vehicle on the rail track as produced by the means for correlating; and f) means for displaying the synthetic, real-time image onboard the rail based vehicle for the operator.

11. The rail synthetic vision system of claim 10, further comprising:

a) means for determining if the rail based vehicle has arrived at a pre-determined orientation of at least a select portion of the rail based vehicle and an intersection of the rail track with a highway at a respective rail track and highway crossing;

b) means for determining if the operator has manually activated an audible horn sound; and c) means for notifying the operator that the manual activation of the audible horn sound has not occurred if manual activation of the audible horn sound has not yet occurred and the means for determining that the rail based vehicle has arrived at the pre-determined orientation relative to the respective rail track and highway crossing.

12. The rail synthetic vision system defined in claim 11 further comprising means for activating a pre-determined audible horn sound at a pre-determined orientation of at least a select portion of the rail based vehicle and an intersection of the rail track with a highway at a respective rail track and highway crossing.

* * * * *